US007863968B1

(12) United States Patent
Perisetty

(10) Patent No.: US 7,863,968 B1
(45) Date of Patent: Jan. 4, 2011

(54) VARIABLE-OUTPUT CURRENT-LOAD-INDEPENDENT NEGATIVE-VOLTAGE REGULATOR

(75) Inventor: Srinivas Perisetty, Santa Clara, CA (US)

(73) Assignee: Altera Corporation, San Jose, CA (US)

( * ) Notice: Subject to any disclaimer, the term of this patent is extended or adjusted under 35 U.S.C. 154(b) by 0 days.

(21) Appl. No.: 12/266,868

(22) Filed: Nov. 7, 2008

(51) Int. Cl.
*G05F 1/10* (2006.01)

(52) U.S. Cl. ..... 327/541; 327/537

(58) Field of Classification Search ..... 327/535–543; 323/313
See application file for complete search history.

(56) References Cited

U.S. PATENT DOCUMENTS 5,825,238 A * 10/1998 Poimboeuf et al. ..... 327/552
6,091,287 A * 7/2000 Salter et al. ..... 327/543
6,580,735 B1 * 6/2003 Theodoras, II ..... 372/38.02
6,980,045 B1 * 12/2005 Liu ..... 327/536
7,129,939 B2 * 10/2006 Toyozawa et al. ..... 345/211
7,397,736 B2 * 7/2008 Ogura ..... 369/44.28
7,501,853 B2 * 3/2009 Ueda ..... 326/33
2007/0216379 A1 * 9/2007 Kitagawa ..... 323/265
2008/0303498 A1 * 12/2008 Huang ..... 323/280

* cited by examiner

*Primary Examiner*—Long Nguyen
*Assistant Examiner*—Sibin Chen
(74) *Attorney, Agent, or Firm*—Martine Penilla & Gencarella, LLP

(57) ABSTRACT

Methods and circuits for implementing negative voltage regulators are provided. The negative voltage regulator circuit includes an operational amplifier (op-amp), a PMOS transistor, and two resistors. The op-amp is powered by positive and negative voltages, and the PMOS transistor has a gate in electrical communication with the op-amp. A first resistor is disposed between a positive reference voltage and a tap point, while the second resistor is disposed between the tap point and the output of the negative voltage regulator circuit. The use of the PMOS transistor facilitates a common drain output stage making the loop gain load independent, resulting in a stable system independent of current load.

17 Claims, 9 Drawing Sheets

VARIABLE-OUTPUT CURRENT-LOAD-INDEPENDENT NEGATIVE-VOLTAGE REGULATOR

CROSS REFERENCE TO RELATED APPLICATIONS

This application is related to U.S. patent application Ser. No. 12/181,206, filed Jul. 28, 2008, and entitled "Performance Improvements in an Integrated Circuit by Selectively Applying Forward Bias Voltages"; and U.S. application Ser. No. 11/636,907, filed on Dec. 11, 2006, and entitled "Integrated Circuit Voltage Regulator", which are incorporated herein by reference.

BACKGROUND

The present invention relates to circuits and methods for generating negative voltages in an integrated circuit, and more particularly, circuits and methods for implementing stable load-independent negative voltage regulators.

The performance increases of new integrated circuits (IC), and particularly Programmable Logic Devices (PLD), including Field-Programmable Gate Arrays (FPGA), can result in significant increases in power consumption, introducing the risk of devices that consume unacceptable amounts of power. Power consumption becomes a critical issue because static power can increase dramatically with higher component densities. Static power consumption rises largely because of increases in leakage current, including tunneling current across the thinner gate oxides that are used in new processes, as well as subthreshold leakage (channel- and drain-to-source current). Also, without any specific power optimization effort, dynamic power consumption can increase due to the higher density of switching transistors combined with the higher switching frequencies that are attainable.

Although power requirements vary across different applications, the benefits of lower power consumption are applicable to any hardware platform because of the inherent cost, complexity, and reliability advantages. Today's design trends—such as increasing compactness of system form factors and portability—have significantly heightened the sensitivity to power consumption in PLDs, in particular. In "tethered" applications where wall power is the primary source, system enclosures are becoming dramatically thinner and smaller, restricting airflow, heat sink, size, and other thermal management solutions. In portable applications, a relatively new domain for FPGAs, battery-life objectives place new restrictions on both static and dynamic power consumption. These shifts in design goals make power consumption one of the critical factors when choosing and programming ICs.

As a result, there is a need to manage the balance between power and performance in today's ICs. One of the ways to accomplish lower power consumption is by using negative voltages to body bias transistors, which requires stable current-load-independent negative voltage regulators with variable output. The current load for the negative voltage regulators can vary within a very large range.

In addition, because of process variations, there can be silicon where the substrate leakage is very low, or silicon where the substrate leakage is very high. This presents problems for the circuit designer, because circuits must operate under a wide range of current loads. As a result, negative voltage regulators operate under a wide range of current loads, and the outputs of the negative voltage regulators have to be stable and independent on whether the current load is small or large. More specifically, the loop gain must be independent of the load current.

It is in this context that embodiments of the invention arise.

SUMMARY

Embodiments of the present invention provide methods and circuits for generating current-load-independent negative voltages in an integrated circuit (IC). A current-load-independent negative-voltage regulator circuit includes an operational amplifier (op-amp), a PMOS (P-type Metal-Oxide-Semiconductor) transistor, and two resistors. The op-amp is powered by positive and negative voltages. The gate of the PMOS transistor is in electrical communication with the op-amp. The drain of the transistor is connected to a negative power source, and the source is connected to the output of the negative voltage regulator. A first resistor is disposed between a positive reference voltage and a tap point, while the second resistor is disposed between the tap point and the output. The use of the PMOS transistor facilitates a common drain output stage making the loop gain current-load independent with variable output, resulting in a stable system.

In one embodiment, a method to generate a negative voltage at an output is provided. The method drives a current through a first resistor with a first terminal connected to a first positive voltage, which is used by an op-amp in a feedback loop designed to generate the variable output. The first resistor has a second terminal connected to a second positive voltage. The method includes passing the current through a second resistor connected to the first terminal of the first resistor and to the source of a PMOS transistor, where the output generating the negative voltage is taken from the source of the PMOS transistor. The drain of the PMOS transistor is in electrical communication with a second negative voltage. The method adjusts the resistance of the second resistor in order to obtain the desired negative voltage at the output.

It should be appreciated that the present invention can be implemented in numerous ways, such as a process, an apparatus, a system, a device or a method on a computer readable medium. Several inventive embodiments of the present invention are described below. Other aspects of the invention will become apparent from the following detailed description, taken in conjunction with the accompanying drawings, illustrating by way of example the principles of the invention.

BRIEF DESCRIPTION OF THE DRAWINGS

The invention may best be understood by reference to the following description taken in conjunction with the accompanying drawings in which.

DETAILED DESCRIPTION

Embodiments of the present invention present methods and circuits for implementing current-load-independent negative-voltage regulators. In one embodiment, the current-load-independent negative-voltage regulator circuit includes a PMOS pass transistor, a Band Gap voltage reference, an operational amplifier (op-amp) and a resistor divider. The use of the PMOS transistor facilitates a common drain output stage making the loop gain load independent. The circuit provides high stability in the presence of varying output voltages and currents.

It will be obvious, however, to one skilled in the art, that the present invention may be practiced without some or all of these specific details. In other instances, well known process operations have not been described in detail in order not to unnecessarily obscure the present invention.

In one embodiment, a negative voltage is generated which is more negative than an existing negative voltage supplied by a negative charge pump. The negative charge pump is connected to the drain of a PMOS transistor, and the output of the voltage regulator is obtained from the source of the PMOS transistor, which is in an open-loop configuration with an operational amplifier. The negative voltage being generated is more negative than the voltage from the negative charge pump, requiring another negative voltage to be supplied by the operational amplifier, in order to turn on the PMOS transistor. Because the output of the voltage regulator is taken from the source of the PMOS transistor, the output is independent from the current load, allowing the voltage regulator to be used in circuits where the current load can vary across a wide range of current values.

Figure 1:
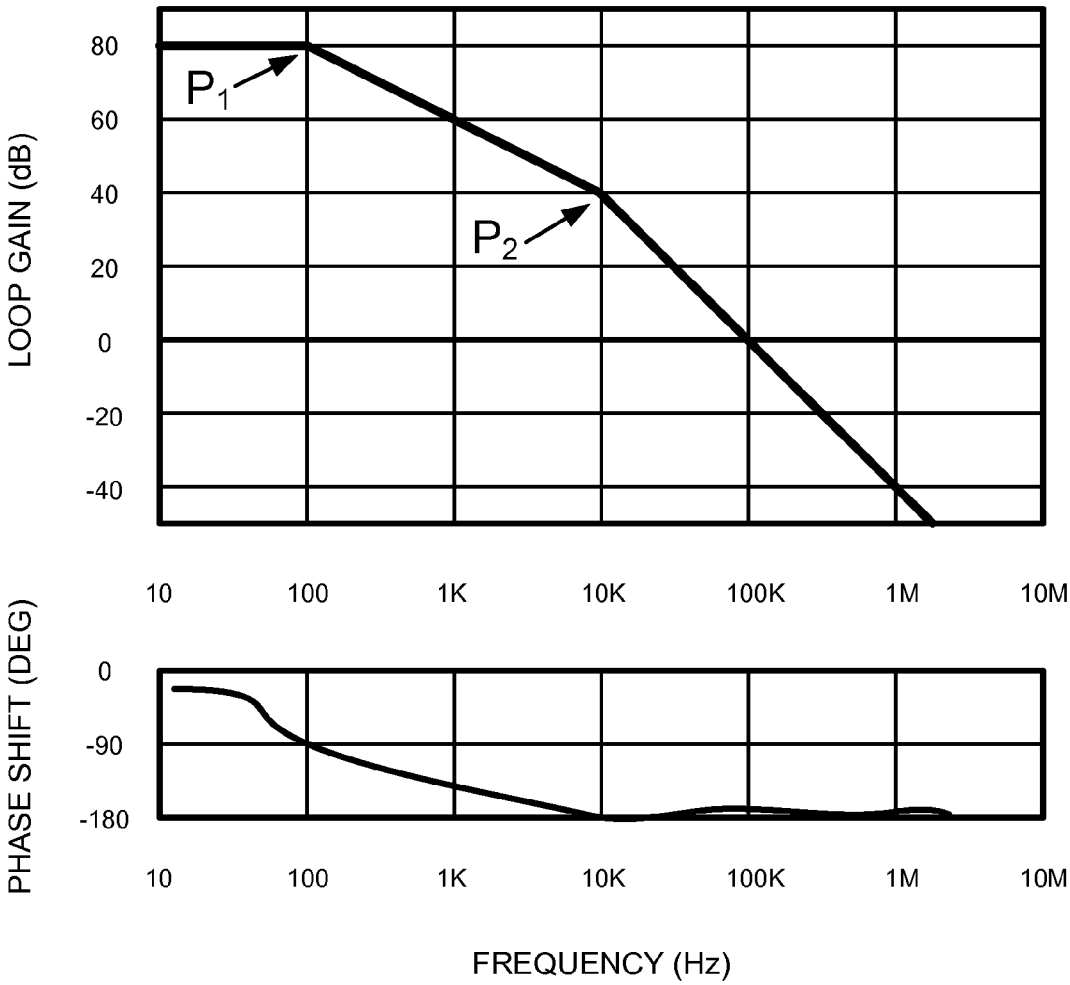
FIG. 1 shows exemplary charts illustrating loop gain and phase shift in an IC as a function of frequency.

FIG. 1 shows exemplary charts illustrating loop gain and phase shift in an open loop gain circuit as a function of frequency. An op-amp (or, in general, any multistage amplifier) will begin to roll off at some frequency because of the low-pass filters formed by signals of finite source impedance driving capacitive loads within the amplifier stages. For instance, having an input stage consisting of a differential amplifier is common, perhaps with current minor load, driving a common-emitter second stage. At low frequencies the gain remains constant, but as the frequency grows, the gain starts to decrease at an approximately constant rate. The points $P_1$ and $P_2$ where the gain function changes slopes, that is, gain losses accelerate with respect to the previous segment, are called poles.

In FIG. 1, pole $P_1$ shows the inflexion point where the gain goes from being substantially constant to a gain function that decreases at a rate of about 20 db/decade. The second pole $P_2$ corresponds to the frequency where the loss changes from 20 db/decade to 40 db/decade. The location of a pole depends in great part on the capacitance to ground. If the circuit sees a resistance, then the capacitance load for the circuit is 0 and the pole gets extended, that is, the pole moves to the right on the chart, resulting in a stable positive gain across a wider spectrum.

The curve at the bottom of FIG. 1 shows a typical phase shift at the output relative to the input signal as a function of the operating frequency of the circuit. When the gain curve hits pole $P_i$, the phase shift is about 90°, and by the second pole $P_2$, the phase shift has reached 180° causing the circuit to oscillate. It should be noted, that oscillation only matters where the gain is positive. If the gain is below 0 dB and the system begins to oscillate, there are no consequences as the circuit is outside the operating range.

The criterion for stability against oscillation for a feedback amplifier is that the open-loop phase shift must be less than 180° at the frequency at which the loop gain (in the feedback configuration) is unity. The goal of the circuit designer is to keep the open-loop phase shift much below 180° at all frequencies for which the loop gain is greater than 1. This can be accomplished by having the poles as far to the right as possible, in order to have a constant gain in the expected operating frequency range of the circuit. However, extending the poles to the right is not easily accomplished because of the capacity load of the circuit.

Figure 2:
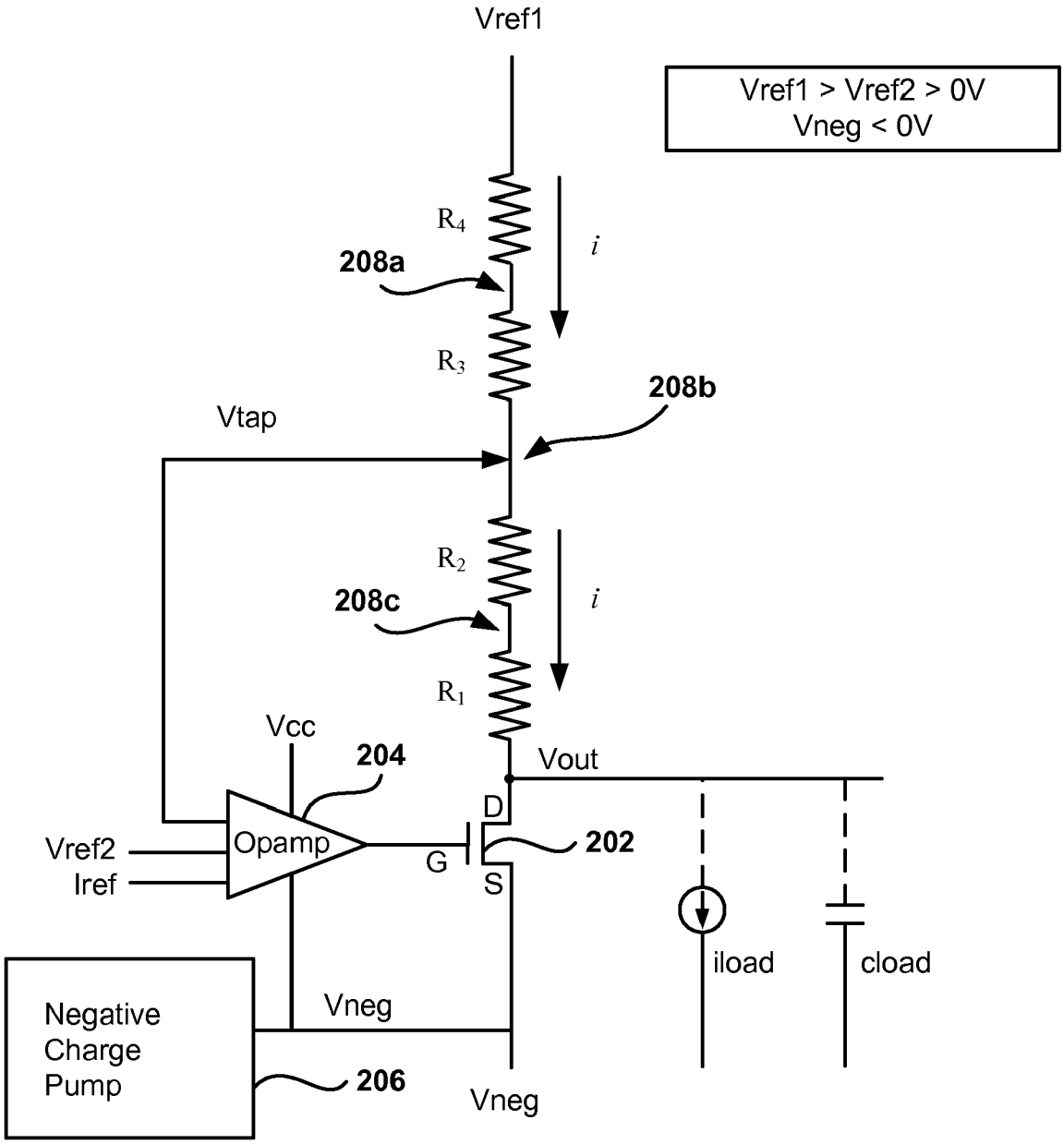
FIG. 2 depicts a negative voltage regulator using an NMOS (N-type Metal-Oxide-Semiconductor) transistor according to one embodiment of the invention.

FIG. 2 depicts a negative voltage regulator using an NMOS transistor according to one embodiment of the invention. In general, an IC can get a positive voltage from an outside source, but a negative voltage needs to be generated inside the IC to have a stable circuit. For example, the negative voltage can be used for negative biasing of transistors in order to decrease power consumption. A negative charge pump 206 circuit is used to generate negative voltage Vneg. In one embodiment, Vout is a negative voltage in the range of Vneg to 0 volts. Op-amp 204 uses a positive power supply Vcc and the negative supply Vneg. Op-amp 204 is in an open-loop gain mode that includes NMOS transistor 202. A band gap circuit (not shown) provides a first reference voltage Vref1 and a second reference voltage Vref2, typically half of Vref1. The selection of resistors $R_1$ to $R_4$ determines the output Vout of the circuit. In one embodiment, different resistor configurations are achieved by changing tap point 208*a*-208*c* in electrical connection with the op-amp.

In one example, Vref1 is 1 volt, Vref2 is 0.5 volts, Vneg is −0.5 volts, and $R_3+R_4$ is 10KΩ. This creates a current i of 50 μA, because Vtap is equal to Vref2 when the circuit is at equilibrium. If a Vout of −0.2 volts is desired, then $R_1+R_2$ will be 14KΩ because i is 50 μA.

Negative voltage regulators, designed for variable output voltage and variable output load current regulators, using NMOS transistors have stability problems as the output pass transistor acts as gain multiplier stage. The circuit needs to be stable across variations in Process, Voltage and Temperature (PVT). If variations cause the phase shift to reach 180°, then the circuit will oscillate.

The voltage generator has capacity load $C_{load}$, and current load $I_{load}$, which can present stability problems. If $I_{load}$ is present, then current leakage is present. The $I_{load}$ can push the pole to the right because the circuit has a resistive load that causes a null $C_{load}$, therefore increasing bandwidth. The $C_{load}$ is variable and a function of the load presented to the circuit. The first pole of the circuit is determined by the op-amp, while the second pole is determined by the $C_{load}$. The circuit is designed to function from no-load to maximum load at the output. For example, if a circuit operating up to 1 MHz is being designed, then there is no need to worry about poles beyond 1 MHz.

Figure 3:
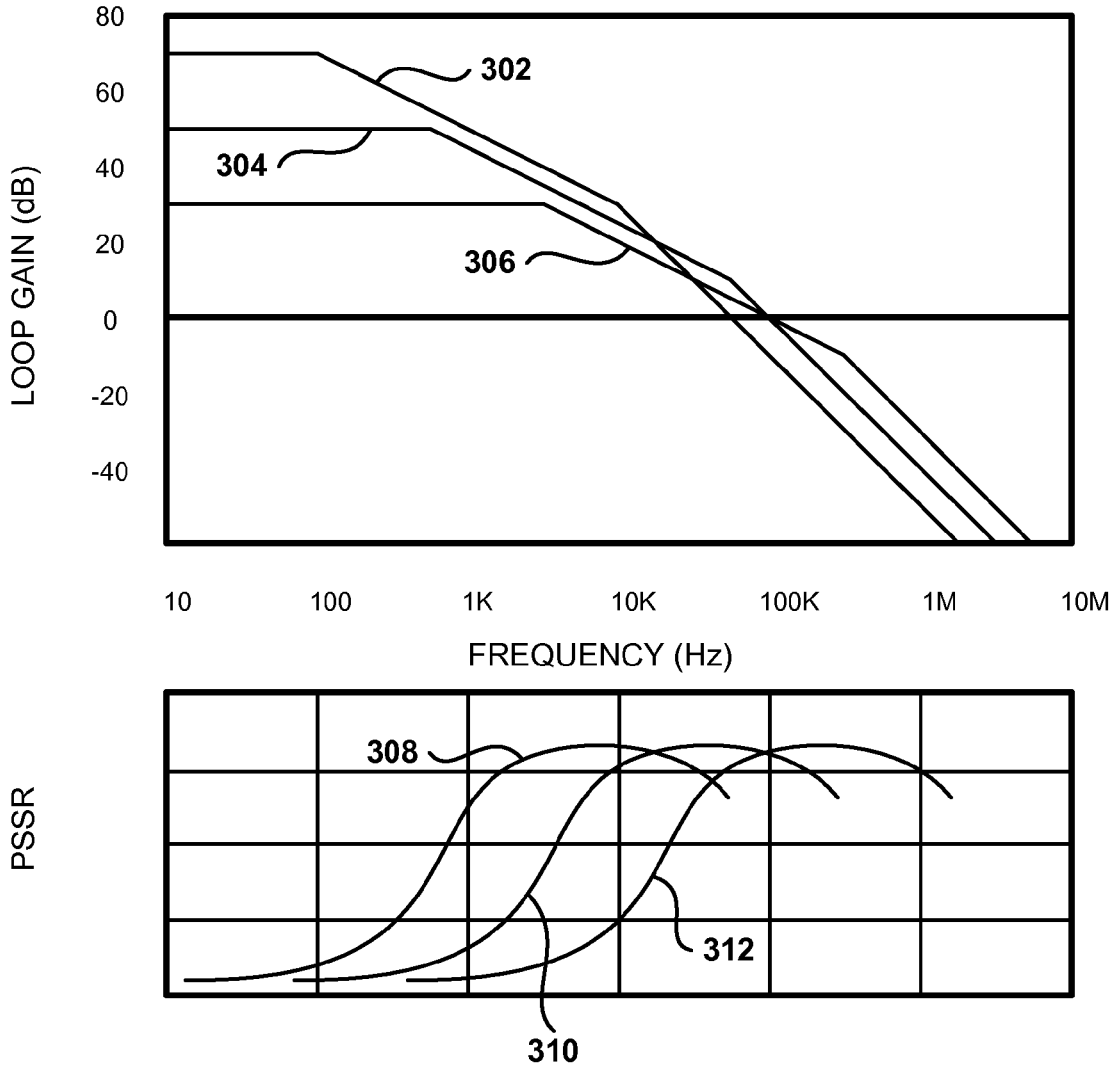
FIG. 3 shows the effects on the stability of a circuit when increasing circuit gain.

FIG. 3 shows the effects on the stability of a circuit when increasing the gain. As gain increases (from curves 306 to 304 to 302), the poles in the respective curves move to the left. If the second pole moves into the operating frequency range, as seen in curves 302 and 304, then the circuit will oscillate.

Another circuit stability issue arises from the effect of noise in the power supply. Power Supply Rejection Ratio (PSRR) is a term widely used in describing op-amps to show the amount of noise from a power supply that a particular op-amp can reject. PSRR is defined as the ratio of the change in supply voltage to the change in output voltage of the op-amp caused by the change in power supply. Typically, PSRR starts rising when the gain hits the first pole, as seen in curve 308 corresponding to curve 302, 310 corresponding to 304, and 312 corresponding to 306.

There are two critical design criteria when designing voltage regulators. First, a system is desired that does not depend on the load. Second, the system must eliminate PSRR in the operating frequency range. The stability and output of the circuit in FIG. 2 depends on the $C_{load}$ and $I_{load}$, therefore the circuit can become unstable depending on the load.

Figure 4A:
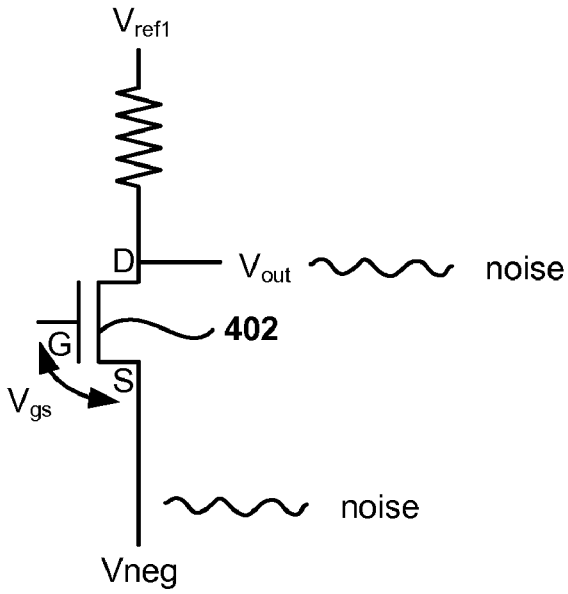
FIGS. 4A-4B depict the effects of a noisy power supply on the output of an IC in accordance with one embodiment.
Figure 4B:
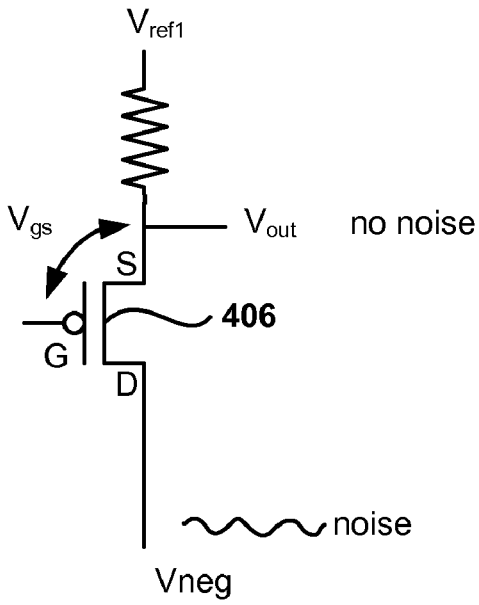

FIGS. 4A-4B depict the effects of noisy supply $V_{neg}$ on the output of an IC in accordance with one embodiment. FIGS. 4A-4B show the effects of supply noise in voltage regulators, such as the one shown in FIG. 2. The effect of supply noise varies according to the transistor and according to the use of the transistor. In FIG. 4A, the circuit using NMOS transistor 402 propagates noise from supply $V_{neg}$ to output $V_{out}$. Output $V_{out}$ is connected to the drain of transistor 402. If $V_{neg}$ is noisy but $V_{gs}$ is stable then noise on $V_{neg}$ will propagate to output $V_{out}$.

The circuit in FIG. 4B uses PMOS transistor 406. However, the output $V_{out}$ is connected to the source of PMOS transistor 406. If $V_{neg}$ is noisy but $V_{gs}$ is stable, then the noise from $V_{neg}$ will not propagate to $V_{out}$.

Figure 5:
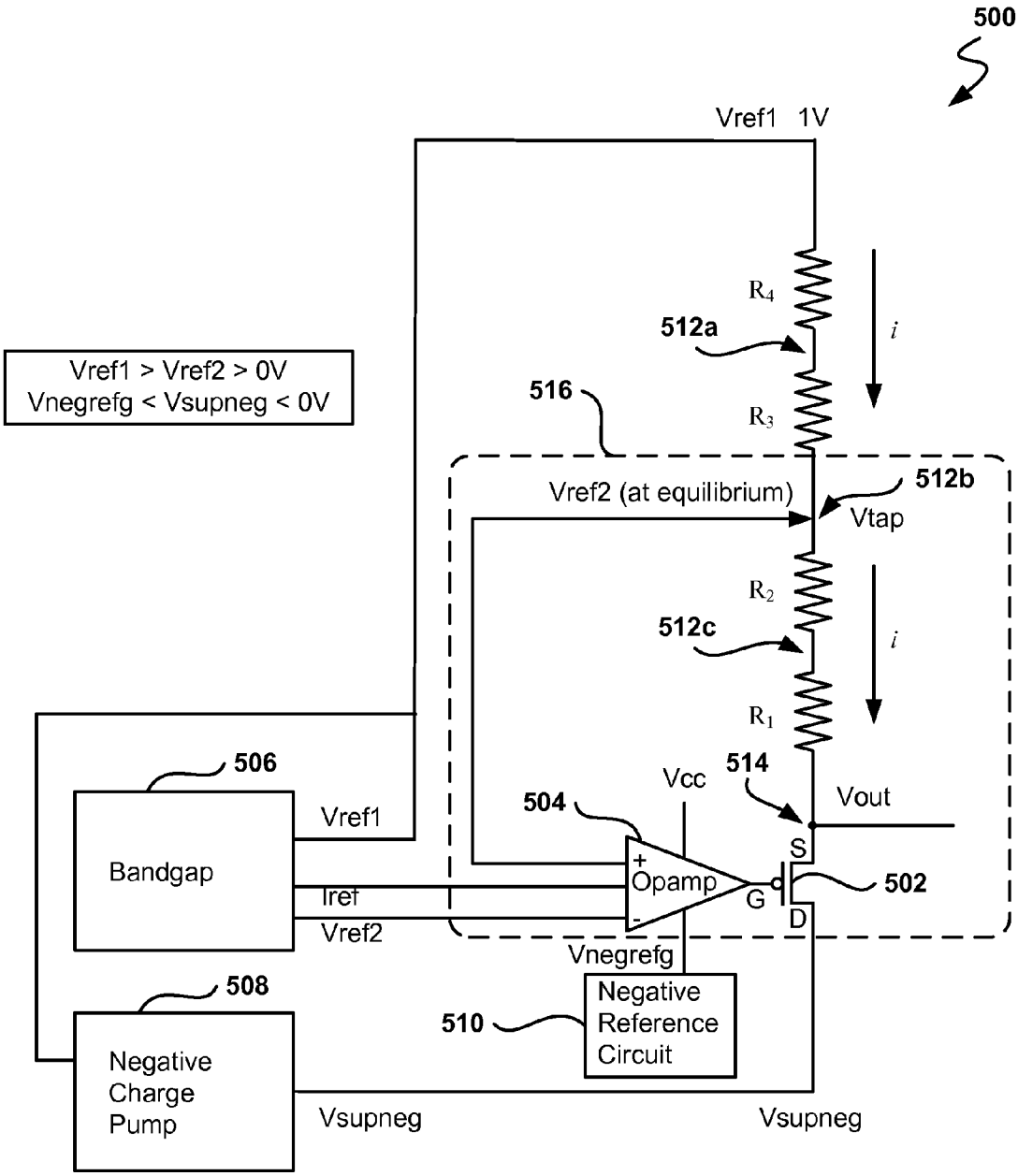
FIG. 5 depicts a current-load-independent negative-voltage regulator using a PMOS transistor according to one embodiment.

FIG. 5 depicts a current-load-independent negative-voltage regulator 500 using PMOS transistor 502 according to one embodiment. Bandgap 506 supplies reference voltage Vref1 to resistors $R_1$ to $R_4$ connected in series to output 514 and to negative charge pump 508. Bandgap 506 also supplies voltage Vref2 to op-amp 504 and current reference to op-amp 504. In one embodiment, Vref2 is half of Vref1. Negative charge pump 508 provides negative voltage Vsupneg to the drain of PMOS transistor 502. Because the gate of PMOS transistor 502 needs to be more negative than the voltage at the source to trigger PMOS transistor 502, a negative reference circuit 510 is used to supply op-amp 504 with voltage Vnegrefg, where Vnegrefg is more negative than voltage Vsupneg. For example, if Vsupneg is −0.5 volts, Vout is −0.5 volts, and threshold voltage $V_T$ is 0.5 volts, then the voltage at the gate has to be less than −1 volt. A sample embodiment of negative reference circuit 510 is presented below with respect to FIG. 6, but other negative reference circuits can be used as long as they are able to produce a negative voltage negative enough to turn on PMOS transistor 502.

Referring back to FIG. 5, op-amp 504 is operating in open loop 516, which includes PMOS transistor 514 and resistors $R_1$ and $R_2$. To regulate the output voltage Vout, the resistor configuration can be changed by selecting one of the tap points 512*a*-512*c*. At equilibrium, voltage Vtap at tap point 512*b* will be equal to Vref2. The range of the output voltage Vout goes from Vsupneg to 0 volts. The value of Vnegrefg is decided based on the size of PMOS transistor 502. The more negative Vnegrefg, the smaller transistor 502 will be for a given current load on Vout. This approach allows for a load independent regulator design as the PMOS transistor forms a common drain stage instead of a common source stage.

Negative voltage regulator 500 eliminates PSRR because the noise from the power supply is not propagated to the output. The output transistor is independent of $I_{load}$ and does not act as a gain multiplier as a function of $I_{load}$. PMOS pass transistor 502 facilitates a common drain output stage. This removes the gain multiplier stage at the output and results in a more stable system by making the loop gain load independent. This configuration removes the need for compensation resistor and capacitor schemes.

Figure 6:
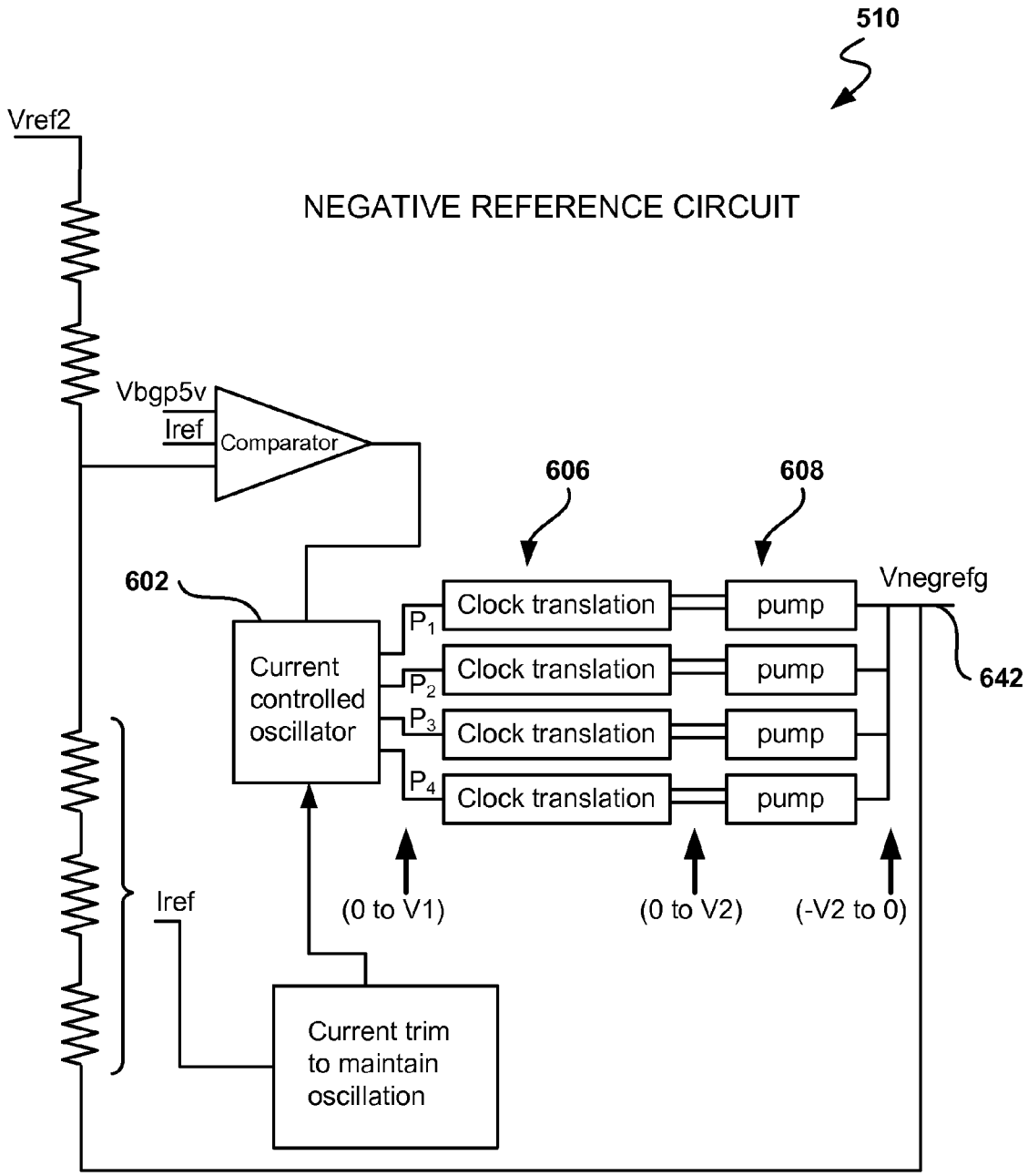
FIG. 6 shows an embodiment of a negative reference circuit that can be used to implement the circuit shown in FIG. 5.

FIG. 6 shows an embodiment of negative reference circuit 510 that can be used to implement the circuit shown in FIG. 5. The clock signals P1-P4 are provided to respective level shifters 606. Level shifters 606 serve to boost the clock signals from current controlled oscillator 602. With this configuration, the current-controlled oscillator 602 produces clock signals P1-P4 that range from 0 to V1 volts at its outputs (e.g. 0 to 0.9 volts) and level shifters 606 produce corresponding level-shifted clock signals on their outputs that range from 0 volts to V2 volts (e.g. 0 to 1.5 volts).

Each of the level shifters 606 has a pair of corresponding outputs at which true and complement versions of the level-shifted clock signals are provided. The true and complement versions of the level-shifted signals are provided to the inputs of corresponding charge pumps 608. Charge pump circuitry 608 produces a correspondingly negative power supply voltage Vnegrefg (e.g. −1.5 volts) at its output 642. Any suitable configuration may be used for charge pumps 608. Charge pumps 608 may have any suitable number of stages.

Figure 7:
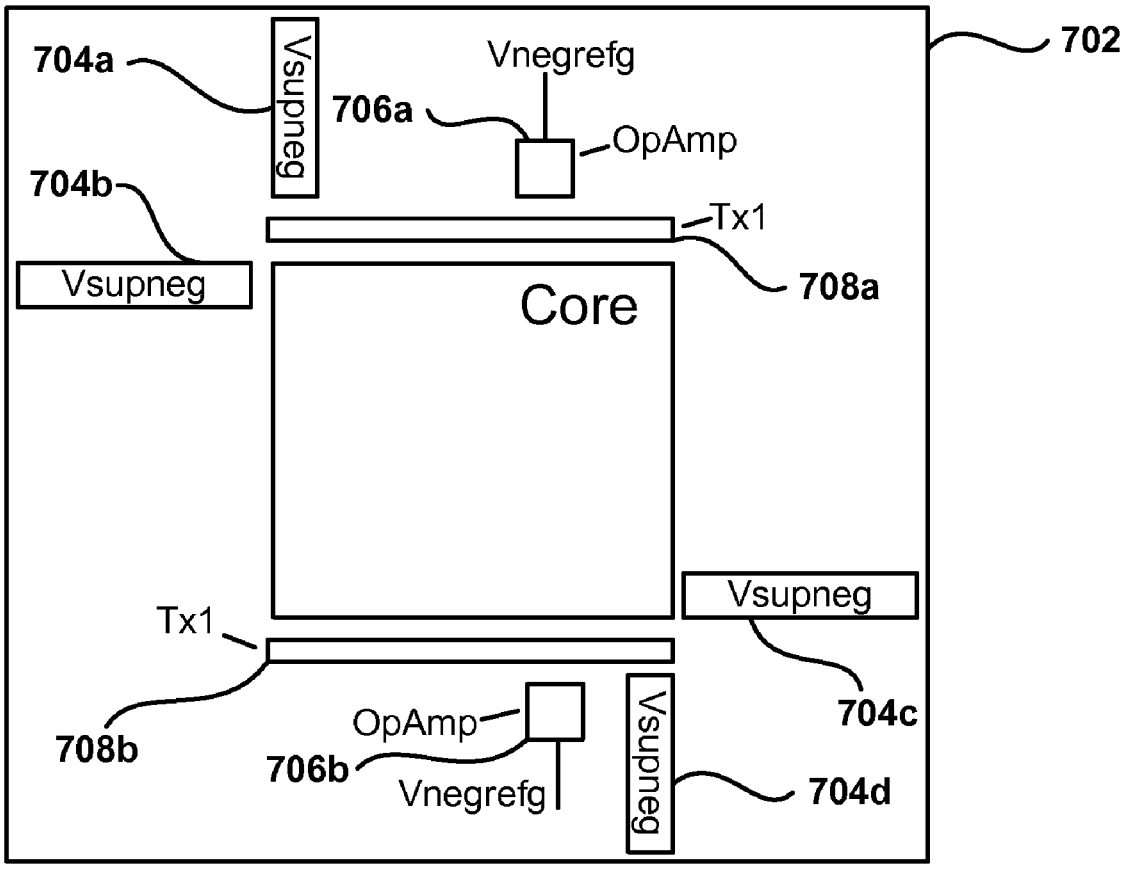
FIG. 7 shows an IC using current-load-independent negative-voltage regulators in accordance with one embodiment.

FIG. 7 shows IC 702 using negative voltage regulators in accordance with one embodiment. Voltage regulators typically do not take a lot of space on the IC. The op-amp circuits 706*a* and 706*b* are relatively small circuits. The pass transistors are distributed across buses 708*a* and 708*b*. The charge pumps do not lend themselves to be distributed, therefore the need to place them together in one location. The different Vsupneg 704*a*-704*d* circuits are replicated at the corners. As a whole, the real estate cost for the negative voltage generators is small for the complete circuit.

Figure 8:
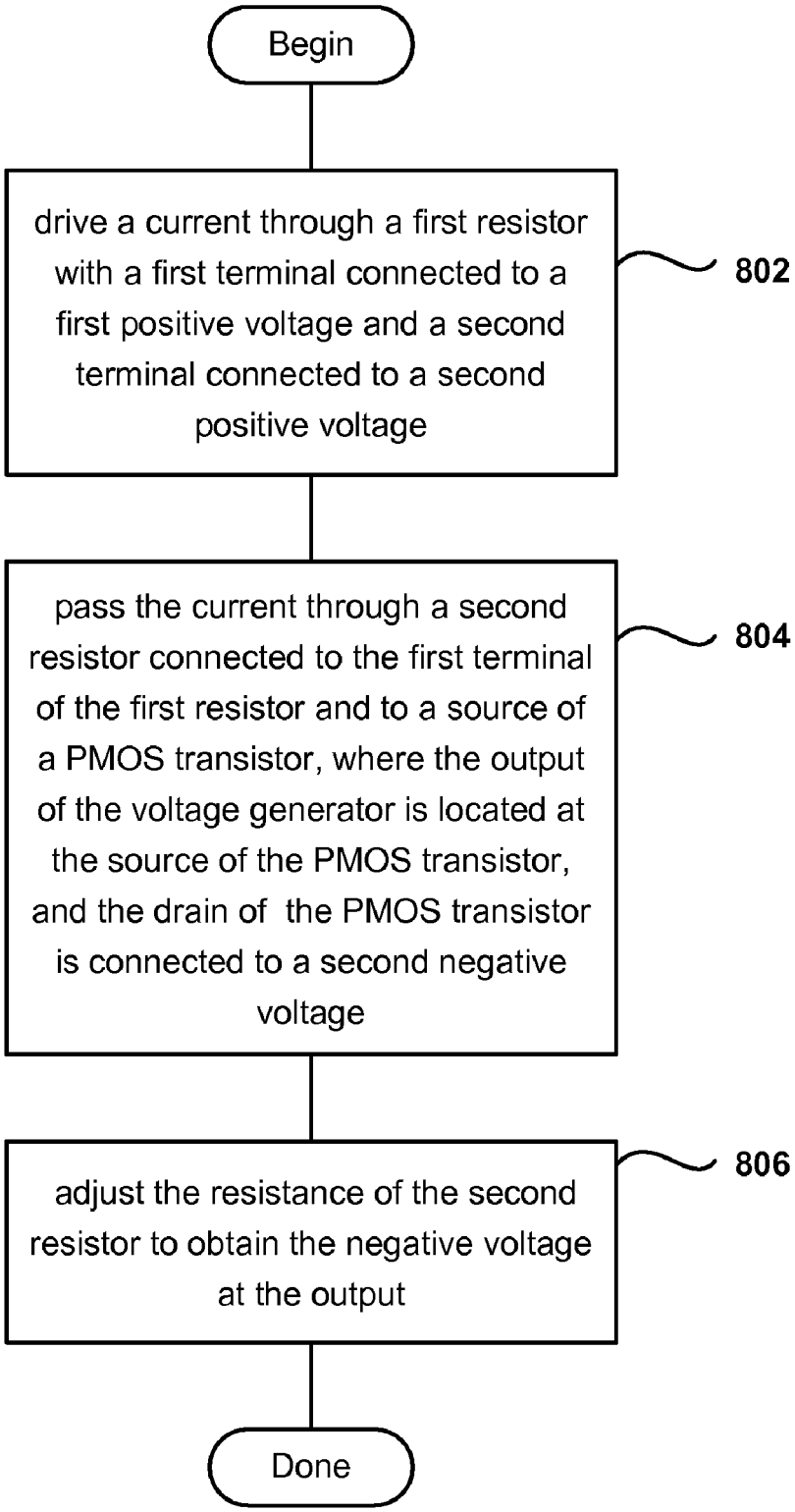
FIG. 8 shows a process flow for generating a negative voltage using a PMOS transistor in accordance with one embodiment.

FIG. 8 shows a process flow for generating a negative voltage using a PMOS transistor in accordance with one embodiment. In operation 802, a current is driven through a first resistor with a first terminal connected to a first positive voltage, such as Vtap 512*b* of FIG. 5, and a second terminal connected to a second positive voltage, such as Vref1. One embodiment of a negative voltage reference circuit is shown in FIG. 6. In operation 804, the current driven by the first resistor in operation 802 is passed thorough a second resistor, such as the combination of $R_1$ and $R_2$ from FIG. 5. The second resistor is connected to the first terminal of the first resistor and to a source of a PMOS transistor, which is the output of the voltage generator. The drain of the PMOS transistor is connected to a second negative voltage, such as Vsupneg in FIG. 5.

In operation 806, the resistance value of the second resistor is adjusted to obtain the negative voltage desired at the output. In one embodiment, the resistance is adjusted by selecting one of a possible tap points 512*a*-512*c* in FIG. 5.

Figure 9:
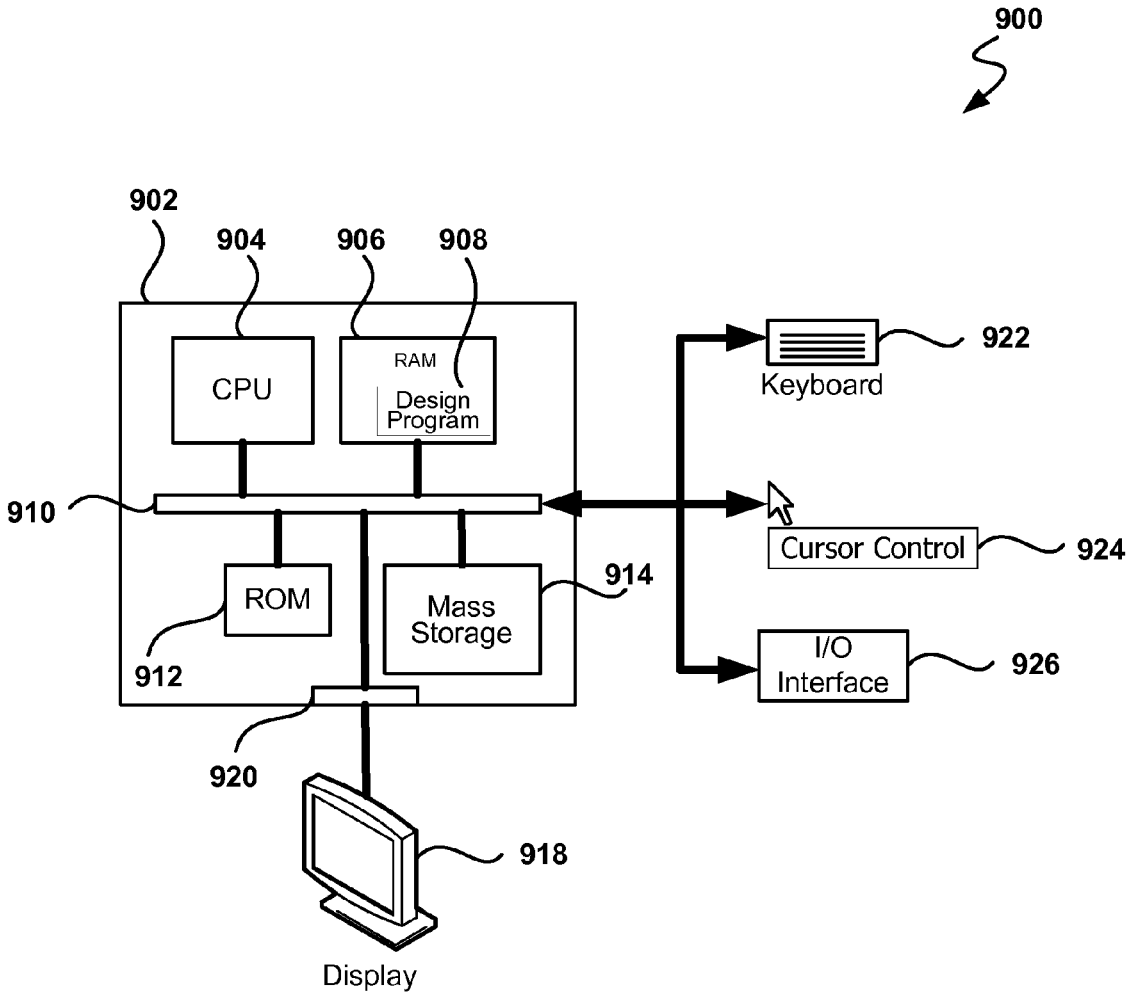
FIG. 9 is a simplified schematic diagram of a computer system for implementing embodiments of the present invention.

FIG. 9 is a simplified schematic diagram of a computer system for implementing embodiments of the present invention. It should be appreciated that the methods described herein may be performed with a digital processing system, such as a conventional, general-purpose computer system. Special purpose computers, which are designed or programmed to perform only one function may be used in the alternative. In addition, the computer system of FIG. 9 may be used to calculate power consumption in PLD circuit designs, timing information, and critical paths for signal propagation in the PLD. The computer system includes a central processing unit (CPU) 904, which is coupled through bus 910 to random access memory (RAM) 906, read-only memory (ROM) 912, and mass storage device 914. Circuit design program 908 resides in random access memory (RAM) 906, but can also reside in mass storage 914. Circuit design program 908 is used to analyze a circuit design using negative voltage regulators and to assess the performance and stability of the circuit design.

Mass storage device 914 represents a persistent data storage device such as a floppy disc drive or a fixed disc drive, which may be local or remote. It should be appreciated that CPU 904 may be embodied in a general-purpose processor, a special purpose processor, or a specially programmed logic device. Display 918 is in communication with CPU 904, RAM 906, ROM 912, and mass storage device 914, through bus 910 and display interface 920. Of course, display 918 is configured to display the user interfaces described herein. Keyboard 922, cursor control 924, and input/output interface 926 are coupled to bus 910 in order to communicate information in command selections to CPU 904. It should be appreciated that data to and from external devices may be communicated through input output interface 926.

Embodiments of the present invention may be practiced with various computer system configurations including hand-held devices, microprocessor systems, microprocessor-based or programmable consumer electronics, minicomputers, mainframe computers and the like. The invention can also be practiced in distributed computing environments where tasks are performed by remote processing devices that are linked through a wire-based or wireless network.

With the above embodiments in mind, it should be understood that the invention can employ various computer-implemented operations involving data stored in computer systems. These operations are those requiring physical manipulation of physical quantities. Usually, though not necessarily, these quantities take the form of electrical or magnetic signals capable of being stored, transferred, combined, compared and otherwise manipulated.

Any of the operations described herein that form part of the invention are useful machine operations. The invention also relates to a device or an apparatus for performing these operations. The apparatus can be specially constructed for the required purpose, or the apparatus can be a general-purpose computer selectively activated or configured by a computer program stored in the computer. In particular, various general-purpose machines can be used with computer programs written in accordance with the teachings herein, or it may be more convenient to construct a more specialized apparatus to perform the required operations.

The methods and systems described herein may be incorporated into any suitable integrated circuit. For example, the methods and systems may be incorporated into other types of programmable logic devices such as programmable array logic (PAL), programmable logic array (PLA), field programmable logic array (FPLA), electrically programmable logic devices (EPLD), electrically erasable programmable logic device (EEPLD), logic cell array (LCA), just to name a few. The programmable logic device may be a part of a data processing system that includes one or more of the following components: a processor, memory; I/O circuitry, and peripheral devices. The data processing system can be used in a wide variety of applications, such as computer networking, data networking, instrumentation, video processing, digital signal processing, or any suitable other application where the advantage of using programmable or re-programmable logic is desirable. The programmable logic device can be used to perform a variety of different logic functions. For example, the programmable logic device can be configured as a processor or controller that works in cooperation with a system processor. The programmable logic device may also be used as an arbiter for arbitrating access to a shared resource in the data processing system. In yet another example, the programmable logic device can be configured as an interface between a processor and one of the other components in the system.

Although the method operations were described in a specific order, it should be understood that other housekeeping operations may be performed in between operations, or operations may be adjusted so that they occur at slightly different times, or may be distributed in a system which allows the occurrence of the processing operations at various intervals associated with the processing, as long as the processing of the overlay operations are performed in the desired way.

Although the foregoing invention has been described in some detail for purposes of clarity of understanding, it will be apparent that certain changes and modifications can be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A current-load-independent negative voltage generator circuit, the circuit comprising:

an op-amp connected to a first negative power supply;

a PMOS transistor having a gate in electrical communication with the op-amp and a drain connected to a second negative power supply, wherein the first negative power supply generates a lower voltage than the second negative power supply;

a first resistor disposed between a first reference voltage and a tap point; and a second resistor disposed between the tap point and an output of the negative voltage generator circuit.

2. The circuit as recited in claim 1, wherein the PMOS transistor has a source connected to the output of the negative voltage generator.

3. The circuit as recited in claim 1, wherein the first negative power supply is a negative reference circuit, the negative reference circuit including, a current controlled oscillator, and a plurality of sources generating the first negative power supply, wherein each source from the plurality of sources operates under offset clock cycles.

4. The circuit as recited in claim 1, wherein a feedback loop is formed by the op-amp, the PMOS transistor, the second resistor and a connection from the tap point to the op-amp.

5. The circuit as recited in claim 4, further comprising, a bandgap voltage reference circuit generating a second reference voltage, the second reference voltage being supplied to an input of the op-amp, wherein a voltage at the tap point is equal to the second reference voltage when the circuit is at equilibrium.

6. The circuit as recited in claim 5, wherein a resistance of the first resistor determines a current passing to the second resistor based on the first reference voltage and the voltage at the tap point.

7. The circuit as recited in claim 6, wherein a resistance of the second resistor determines the output of the negative voltage generator based on the passed current.

8. The circuit as recited in claim 1, wherein the tap point is selected from a plurality of tap points located between a plurality of resistors connected in series.

9. A method to generate a current-load-independent negative voltage at an output, the method comprising:

driving a current through a first resistor with a first terminal connected to a first positive voltage and a second terminal connected to a second positive voltage;

passing the current through a second resistor connected to the first terminal of the first resistor and to a source of a PMOS transistor, the output being at the source of the PMOS transistor, a drain of the PMOS transistor being connected to a second negative voltage, a gate of the PMOS transistor being in electrical communication with an op-amp connected to a first negative voltage, the first negative voltage being lower than the second negative voltage; and adjusting the resistance of the second resistor to obtain the negative voltage at the output.

10. The method as recited in claim 9, wherein driving a current further includes, adjusting the resistance of the first resistor to control the current.

11. The method as recited in claim 9, further including using a feedback loop to fix the first positive voltage.

12. The method as recited in claim 9, wherein adjusting the resistance of the second resistor further includes, selecting a contiguous subset of resistors from a plurality of resistors connected in series.

13. A circuit for generating a negative voltage at an output, the circuit comprising:

a PMOS transistor having a source in electrical communication with the output and a drain connected to a second negative power supply; and an op-amp in electrical communication with a gate of the PMOS transistor and with a first negative power supply, the first negative power supply generating a lower voltage than the second negative power supply;

wherein the PMOS transistor and the op-amp are in a feedback loop, wherein the circuit generates an output voltage lower than the second negative power supply.

14. The circuit as recited in claim 13, wherein the second negative power supply is a negative charge pump circuit.

15. The circuit as recited in claim 13, further including, a first resistor, and a second resistor connected in series with the first resistor, the second resistor being part of the feedback loop, wherein the voltage at the connection between the first resistor and the second resistor is fixed by the feedback loop.

16. The circuit as recited in claim 15, further including, a first positive reference voltage connected to the first resistor, and a second positive reference voltage connected to the op-amp.

17. The circuit as recited in claim 16, further including, a bandgap voltage reference circuit that generates the first and second positive reference voltages.

* * * * *